US008760257B2

(12) United States Patent
Park et al.

(10) Patent No.: US 8,760,257 B2
(45) Date of Patent: Jun. 24, 2014

(54) TRANSMISSION LINE TRANSFORMER WHICH MINIMIZES SIGNAL LOSS

(75) Inventors: Jong Hoon Park, Incheon (KR); Chang Kun Park, Suwon-si (KR)

(73) Assignee: Soongsil University—Research Consortium Techno-Park, Seoul (KR)

( * ) Notice: Subject to any disclaimer, the term of this patent is extended or adjusted under 35 U.S.C. 154(b) by 0 days.

(21) Appl. No.: 13/880,163

(22) PCT Filed: Sep. 7, 2011

(86) PCT No.: PCT/KR2011/006594

§ 371 (c)(1),
(2), (4) Date: Apr. 18, 2013

(87) PCT Pub. No.: WO2012/057450

PCT Pub. Date: May 3, 2012

(65) Prior Publication Data

US 2013/0200981 A1 Aug. 8, 2013

(30) Foreign Application Priority Data

Oct. 28, 2010 (KR) ..... 10-2010-0105980

(51) Int. Cl.
*H01F 5/00* (2006.01)

(52) U.S. Cl.
USPC ..... 336/200

(58) Field of Classification Search
USPC ..... 336/200, 232, 206–208
See application file for complete search history.

(56) References Cited

U.S. PATENT DOCUMENTS

| | | | | |
|---|---|---|---|---|
| 7,420,424 | B2 * | 9/2008 | Park et al. | 330/302 |
| 7,548,134 | B2 | 6/2009 | Park et al. | |
| 7,592,865 | B2 | 9/2009 | Park et al. | |
| 2006/0232355 | A1 | 10/2006 | Park et al. | |
| 2009/0009241 | A1 | 1/2009 | Park et al. | |
| 2009/0085666 | A1 * | 4/2009 | Ohnishi et al. | 330/286 |
| 2011/0204993 | A1 * | 8/2011 | Masuda | 333/128 |
| 2013/0187745 | A1 * | 7/2013 | Park et al. | 336/200 |
| 2013/0207739 | A1 * | 8/2013 | Bakalski | 333/33 |

FOREIGN PATENT DOCUMENTS

| | | | |
|---|---|---|---|
| KR | 10-0656335 | B1 | 10/2006 |
| KR | 10-2007-0105936 | A | 10/2007 |
| KR | 10-2008-0025533 | A | 3/2008 |
| KR | 10-2008-0045890 | A | 5/2008 |

* cited by examiner

*Primary Examiner* — Tuyen Nguyen
(74) *Attorney, Agent, or Firm* — Sherr & Jiang, PLLC

(57) ABSTRACT

Provided is a transmission line transformer, and more particularly, a transmission line transformer capable of decreasing a power loss caused by a parasitic resistance component of the transmission line transformer and improving a coupling factor by forming a primary transmission line and a secondary transmission line parallel to each other on an integrated circuit (IC) by using a highest layer metal line, and forming a lower layer metal line immediately below the highest layer metal line in addition to the highest layer metal line in a region where the primary transmission line and the secondary transmission line face each other, while forming the transmission line transformer used in a high frequency circuit via a semiconductor process.

6 Claims, 2 Drawing Sheets

*-Prior Art-*

*-Prior Art-*

*-Prior Art-*

TRANSMISSION LINE TRANSFORMER WHICH MINIMIZES SIGNAL LOSS

CROSS REFERENCE TO PRIOR APPLICATION

This application is a National Stage Patent Application of PCT International Patent Application No. PCT/KR2011/006594 (filed on Sep. 7, 2011) under 35 U.S.C. §371, which claims priority to Korean Patent Application No. 10-2010-0105980 (filed on Oct. 28, 2010) which are all hereby incorporated by reference in their entirety.

TECHNICAL FIELD

The present invention relates to a transmission line transformer, and more particularly, to a transmission line transformer capable of decreasing a power loss caused by a parasitic resistance component of a transformer and improving a coupling factor, by forming a primary transmission line and a secondary transmission line in parallel by using a highest layer metal line on an integrated circuit (IC) and adding an immediate lower layer metal line of the highest layer metal line to a region where the primary transmission line and the secondary transmission line face each other in additional to the highest layer metal line forming the primary and secondary transmission lines, while forming the transmission line transformer used for a high frequency circuit via semiconductor processes.

BACKGROUND ART

FIG. 1 illustrates an example of a conventional transmission line transformer. In FIG. 1, a reference numeral 101 denotes a primary transmission line and a reference numeral 102 denotes a secondary transmission line of the conventional transmission line transformer. Reference numerals 103 and 104 denote ports connected to the primary transmission line 101, and reference numerals 105 and 106 denote ports connected to the secondary transmission line 102. As shown in a cross-sectional view 109 of the conventional transmission line transformer of FIG. 1, the conventional transmission line transformer formed on an integrated circuit (IC) includes two metal lines on a semiconductor substrate, wherein an insulator is disposed between the metal lines and the semiconductor substrate.

FIG. 2 is a schematic diagram for describing operation principles of the conventional transmission line transformer. A reference numeral 202 of FIG. 2 denotes a direction of a current applied to the primary transmission line 101. When the current is applied to the primary transmission line 101 in the direction 202, a current in a direction 203 is induced in the secondary transmission line 102. Accordingly, the current in the direction 203 opposite to the direction 202 of the current flowing through the primary transmission line 101 is always induced in the secondary transmission line 102. Also, if the conventional transmission line transformer is ideal and thus lossless, a current size in the secondary transmission line 102 is always the same as a current size in the primary transmission line 101.

In the conventional transmission line transformer shown in FIGS. 1 and 2, the primary transmission line 101, the secondary transmission line 102, a metal line 107, and a metal line 108 use a highest layer metal line provided in a corresponding semiconductor process because as a metal line forming a transmission line transformer and a semiconductor substrate are close to each other, a parasitic capacitance component may be generated between the metal line and the semiconductor substrate, and thus a power loss of a signal may be generated on the semiconductor substrate due to a magnetic field generated in the metal line.

A current is induced to the secondary transmission line 102 by a current of the primary transmission line 101 due to a magnetic field formed around the secondary transmission line 102 by the current of the primary transmission line 101. Generally, a coupling factor is used as an index indicating a size of the current induced to the secondary transmission line 102 by the current of the primary transmission line 101. In order to increase the coupling factor, the magnetic field formed by the current of the primary transmission line 101 should largely affect the secondary transmission line 102. Accordingly, as shown in a region 201 of FIG. 2, lengths of the primary transmission line 101 and the secondary transmission line 102 should be long. However, when the lengths of the primary and secondary transmission lines 101 and 102 are increased, a power loss is generated in the transmission line transformer due to the parasitic resistance component caused by metal lines forming the primary and secondary transmission lines 101 and 102. As a result, a length of a metal line forming a transmission line transformer should be increased to increase a coupling factor of the transmission line transformer, but when the length of the metal line is increased, a parasitic resistance component is also increased, thereby causing a power loss.

Accordingly, another conventional transmission line transformer shown in FIG. 3 has been suggested, wherein a parasitic resistance component is decreased by reinforcing a metal line forming the other conventional transmission line transformer, and increasing a coupling factor of the other conventional transmission line transformer. The primary transmission line 101, the secondary transmission line 102, the metal line 107, and the metal line 108 forming the other conventional transmission line transformer of FIG. 3 are formed by using a highest layer metal layer provided in a corresponding semiconductor process. In addition, metal lines 301 and 302 immediately below the highest layer metal line are formed. The metal lines 107 and 301 are electrically connected to each other through a via 303. Similarly, the metal lines 108 and 302 are electrically connected to each other through another via 303. According to the other conventional transmission line transformer of FIG. 3, a coupling factor may be increased as an area of the primary and secondary transmission lines 101 and 102 facing each other is increased while a size of a parasitic resistance component caused by a metal line may be decreased as the primary and secondary transmission lines 101 and 102 are formed by using two layers of metal lines. However, as described above, since the other conventional transmission line transformer of FIG. 3 not only uses a highest layer metal line but also a metal line immediately below the highest layer metal line, a distance between a metal line to which a signal is applied and a semiconductor substrate is decreased, and thus a power loss of a signal on the semiconductor substrate may be higher than that in the conventional transmission line transformer of FIG. 1.

DETAILED DESCRIPTION OF THE INVENTION

Technical Problem

The present invention provides a transmission line transformer capable of decreasing a power loss caused by a parasitic resistance component of the transmission line transformer and improving a coupling factor by forming a primary transmission line and a secondary transmission line parallel to each other on an integrated circuit (IC) by using a highest layer metal line, and forming a lower layer metal line immediately below the highest layer metal line in addition to the highest layer metal line in a region where the primary transmission line and the secondary transmission line face each other, while forming the transmission line transformer used in a high frequency circuit via a semiconductor process.

Technical Solution

According to an aspect of the present invention, there is provided a transmission line transformer, and more particularly, a transmission line transformer capable of decreasing a power loss caused by a parasitic resistance component of the transmission line transformer and improving a coupling factor by forming a primary transmission line and a secondary transmission line parallel to each other on an integrated circuit (IC) by using a highest layer metal line, and forming a lower layer metal line immediately below the highest layer metal line in addition to the highest layer metal line in a region where the primary transmission line and the secondary transmission line face each other, while forming the transmission line transformer used in a high frequency circuit via a semiconductor process.

According to an aspect of the present invention, there is provided a transmission line transformer formed on an IC and capable of forming two or more metal layers, the transmission line transformer including: a primary transmission line including a first metal line formed of a highest layer metal layer; a secondary transmission line disposed parallel to a proceeding direction of the primary transmission line and including a second metal line formed of the highest layer metal layer; a third metal line having a width narrower than the first metal line forming the primary transmission line, connected to the first metal line by using a via process, disposed close to the second metal line forming the secondary transmission line, and using an metal layer immediately below the highest layer metal layer forming the primary transmission line; and a fourth metal line having a width narrower than the second metal line forming the secondary transmission line, connected to the second metal line by using a via process, disposed close to the first metal line forming the primary transmission line, and using a metal layer immediately below the highest layer metal layer forming the secondary transmission line.

Several preferred embodiments of the invention are as below;

A width of the first metal line forming the primary transmission line may be wider than a width of the second metal line forming the secondary transmission line.

A width of the second metal line forming the secondary transmission line may be wider than a width of the first metal line forming the primary transmission line.

A width of the third metal line may be wider than a width of the fourth metal line.

A width of a fourth metal line may be wider than a width of the third metal line.

The fourth metal line may be formed without the third metal line.

The third metal line may be formed without the fourth metal line.

Advantageous Effects

According to the present invention, a power loss caused by a parasitic resistance component of a transmission line transformer may be decreased and a coupling factor may be improved by forming a primary transmission line and a secondary transmission line parallel to each other on an integrated circuit (IC) by using a highest layer metal line, and forming a lower layer metal line immediately below the highest layer metal line in addition to the highest layer metal line in a region where the primary transmission line and the secondary transmission line face each other, while forming the transmission line transformer used in a high frequency circuit via a semiconductor process.

BEST MODE

Hereinafter, a transmission line transformer having increased signal efficiency according to one or more exemplary embodiments of the present invention will be described more fully with reference to accompanying drawings.

Figure 1:
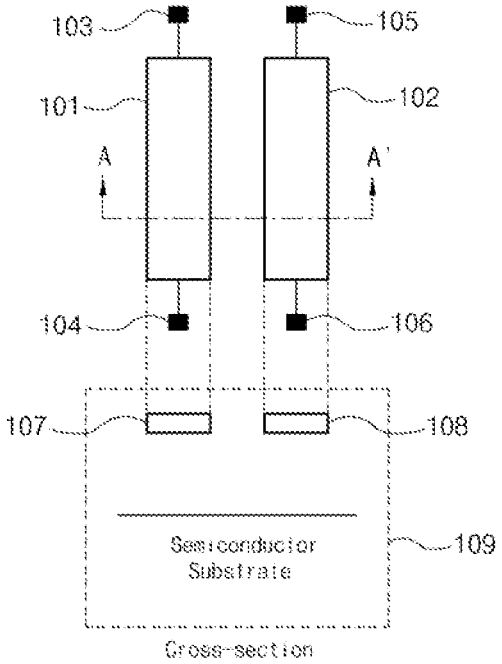
FIG. 1 is a diagram of an example of a conventional transmission line transformer formed on an integrated circuit (IC)
Figure 2:
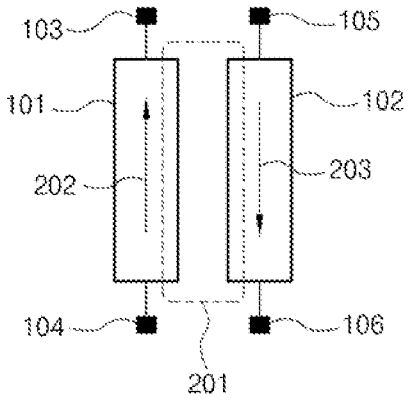
FIG. 2 is a diagram showing directions of currents flowing through a primary transmission line and a secondary transmission line of the conventional transmission line transformer.
Figure 4:
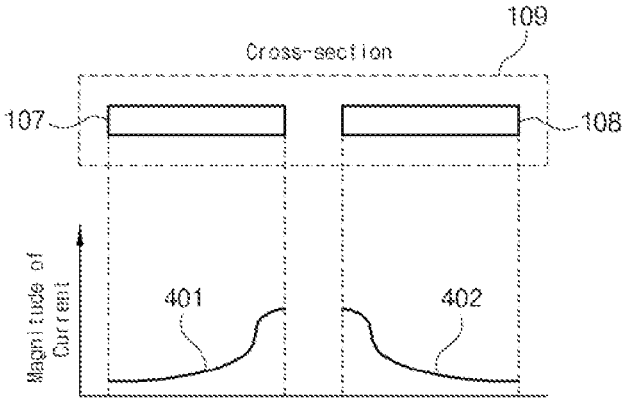
FIG. 4 is a cross-sectional view of a conventional transmission line formed on an IC, and illustrates a distribution of currents flowing through a primary transmission line and a secondary transmission line.

FIG. 4 is a diagram showing a distribution of currents flowing through a general transmission line transformer. Here, for convenience of drawing, the cross-sectional view 109 of the conventional transmission line transformer of FIG. 1 is used. In FIG. 4, a reference numeral 401 denotes a current distribution in a metal line forming a primary transmission line 107 of the general transmission line transformer. Similarly, a reference numeral 402 denotes a current distribution in a metal line forming a secondary transmission line 108 of the general transmission line transformer. According to the current distributions 401 and 402, a current flowing through the primary transmission line 107 increases towards the secondary transmission line 108, and similarly, a current flowing through the secondary transmission line 108 increases towards the primary transmission line 107. This is because directions of the currents flowing through the primary transmission line 107 and the secondary transmission line 108 are opposite to each other.

Figure 5:
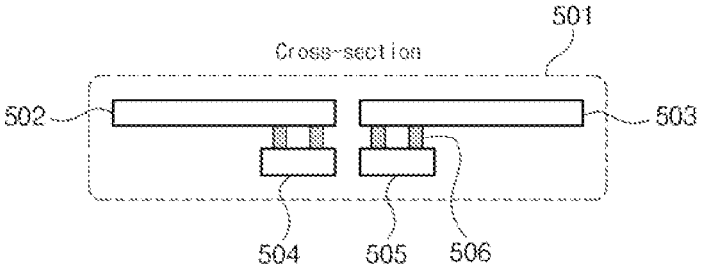
FIG. 5 is a diagram of a transmission line transformer formed on an IC, according to an embodiment of the present invention.

An embodiment of the present invention is designed based on such current distributions, and FIG. 5 is a diagram of a transmission line transformer according to an embodiment of the present invention. In FIG. 5, a reference numeral 502 denotes a highest layer metal line forming a primary transmission line, and a reference numeral 503 denotes a highest layer metal line forming a secondary transmission line. A reference numeral 504 denotes a metal line immediately below the highest layer metal line 502 forming the primary transmission line, wherein the metal line 504 has a width narrower than the highest layer metal line 502 and is disposed close to the highest layer metal line 503 forming the secondary transmission line. Also, the highest layer metal line 502 and the metal line 504 forming the primary transmission line are electrically connected to each other through a via. Similarly, a reference numeral 505 denotes a metal line immediately below the highest layer metal line 503 forming the secondary transmission line, wherein the metal line 505 has a width narrower than the highest layer metal line 503 and is disposed close to the highest layer metal line 502 forming the primary transmission line. Also, the highest layer metal line 503 and the metal line 505 forming the secondary transmission line are electrically connected to each other through a via.

In the transmission line transformer of FIG. 5, a region where the primary and secondary transmission lines face each other, i.e., a region where a current is most densely distributed in the transmission line transformer, is reinforced by the metal lines 504 and 505 as described above with reference to FIG. 4. According to the transmission line transformer of FIG. 5, an area of the region where the primary and secondary transmission lines face each other is increased, and thus a coupling factor is improved by the metal lines 504 and 505. Also, since the region where the current is most densely distributed is reinforced by the metal lines 504 and 505, the value of a parasitic resistance caused by a metal line of the transmission line transformer may be reduced.

Figure 3:
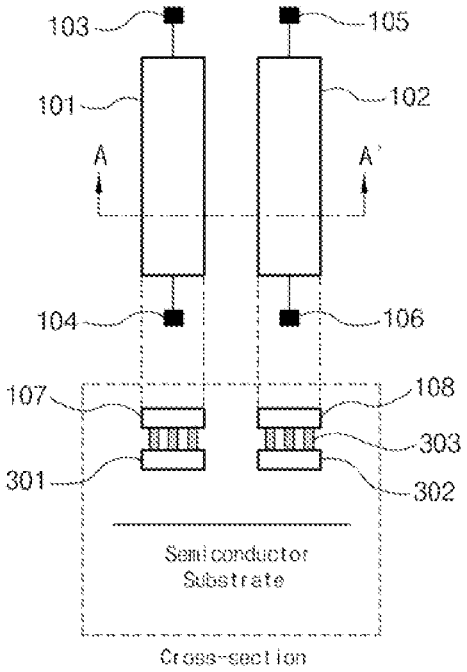
FIG. 3 is a diagram of another example of a conventional transmission line formed on an IC.

Also, since a width of a metal line immediately below a highest layer metal line is smaller in the transmission line transformer of FIG. 5 than in the conventional transmission line transformer of FIG. 3, an increase of the value of a parasitic capacitance existing between the metal lines 504 and 505 and the semiconductor substrate may be reduced.

Accordingly, the transmission line transformer according to the current embodiment of the present invention is capable of improving the coupling factor and decreasing the value of a parasitic resistance while reducing an amount of parasitic capacitance that may be additionally generated.

Alternatively, a width of the highest layer metal line 502 forming the primary transmission line and a width of the highest layer metal line 503 forming the secondary transmission line may be formed to be different from each other according to an actual use of the transmission line transformer in a high frequency circuit. Generally, since a signal having large power is applied to the primary transmission line and power of a signal induced in the secondary transmission line is smaller than power of the signal applied to the primary transmission line, the width of the highest layer metal line 502 forming the primary transmission line may be formed to be larger than the width of the highest layer metal line 503 forming the secondary transmission line.

Similarly, the widths of the metal lines 504 and 505 of FIG. 5 may vary according to a use in the high frequency circuit.

Alternatively, only the metal line 504 or 505 may be formed according to a use in the high frequency circuit.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A transmission line transformer formed on an integrated circuit (IC) and capable of forming two or more metal layers, the transmission line transformer comprising:

a primary transmission line comprising a first metal line formed of a highest layer metal layer, the first metal line having a first width and a first side;

a secondary transmission line disposed parallel to a proceeding direction of the primary transmission line and comprising a second metal line formed of the highest layer metal layer, the second metal line having a second width and a second side facing and adjacent to the first side of the first metal line, wherein an induced current is generated in the second metal line when a current is applied to the first metal line;

a third metal line having a third width narrower than the first width of the first metal line forming the primary transmission line, electrically connected to the first metal line by a via, disposed under the first metal line to be substantially parallel to the first metal line, positioned adjacent to the first side to be close to the second metal line forming the secondary transmission line, and using an metal layer immediately below the highest layer metal layer forming the primary transmission line; and a fourth metal line having a fourth width narrower than the second width of the second metal line forming the secondary transmission line, electrically connected to the second metal line by a via, disposed under the second metal line to be substantially parallel to the second metal line, positioned adjacent to the second side to be close to the first metal line forming the primary transmission line, and using a metal layer immediately below the highest layer metal layer forming the secondary transmission line.

2. The transmission line transformer of claim 1, wherein a width of the first metal line forming the primary transmission line is wider than a width of the second metal line forming the secondary transmission line.

3. The transmission line transformer of claim 1, wherein a width of the second metal line forming the secondary transmission line is wider than a width of the first metal line forming the primary transmission line.

4. The transmission line transformer of claim 1, wherein a width of the third metal line is wider than a width of the fourth metal line.

5. The transmission line transformer of claim 1, wherein a width of a fourth metal line is wider than a width of the third metal line.

6. The transmission line transformer of claim 1, wherein the third width of the third metal line is smaller than a half of the first width of the first metal line and the fourth width of the fourth metal line is smaller than a half of the second width of the second metal line.

* * * * *